US007237467B1

(12) United States Patent
Melton

(10) Patent No.: US 7,237,467 B1
(45) Date of Patent: Jul. 3, 2007

(54) SOUND SUPPRESSOR

(75) Inventor: Douglas M. Melton, 1221 E. Del Rio Dr., Tempe, AZ (US) 85282

(73) Assignee: Douglas M. Melton, Tempe, AZ (US)

( * ) Notice: Subject to any disclaimer, the term of this patent is extended or adjusted under 35 U.S.C. 154(b) by 347 days.

(21) Appl. No.: 10/833,046

(22) Filed: Apr. 28, 2004

(51) Int. Cl.
*F41A 21/30* (2006.01)

(52) U.S. Cl. ..... 89/14.4

(58) Field of Classification Search ..... 89/14.4
See application file for complete search history.

(56) References Cited

U.S. PATENT DOCUMENTS

| | | | | |
|---|---|---|---|---|
| 1,874,326 | A * | 8/1932 | Mason | 181/255 |
| 1,990,837 | A * | 2/1935 | Morgenstern | 181/255 |
| 3,385,164 | A | 5/1968 | Walther et al. | |
| 3,748,956 | A * | 7/1973 | Hubner | 89/14.4 |
| 3,786,895 | A * | 1/1974 | Perrine | 181/223 |
| 4,291,610 | A * | 9/1981 | Waiser | 89/14.4 |
| 4,576,083 | A | 3/1986 | Seberger | |
| 4,588,043 | A | 5/1986 | Finn | |
| 5,164,535 | A * | 11/1992 | Leasure | 89/14.4 |
| 6,374,718 | B1 * | 4/2002 | Rescigno et al. | 89/14.4 |
| 6,425,310 | B1 * | 7/2002 | Champion | 89/14.3 |
| 6,575,074 | B1 | 6/2003 | Gaddini | |
| 2004/0129131 | A1 * | 7/2004 | Kazyaka et al. | 89/14.4 |

* cited by examiner

*Primary Examiner*—Troy Chambers

(57) ABSTRACT

A sound suppressor for a firearm comprises a cylindrical housing having a proximal end with means for attachment to a firearm and to the cylindrical housing, and a distal end with means for attachment to the housing, and a plurality of baffle elements positioned within the housing between the proximal and distal ends of the suppressor. A plurality of spacer elements is positioned between the proximal and distal ends of the suppressor and between the baffle elements. The baffle element comprises a symmetrical conical baffle with a hemispherical shaped apex, with said apex being provided with a concentric hole. The symmetrical conical baffle is also provided with a plurality of steps or annular shoulders on the exterior of the conical baffle, and these annular shoulders increase in diameter with respect to their position on the exterior of the baffle and with respect to the distance from the hemispherical shaped apex of the baffle. In an alternate embodiment, the symmetrical conical baffles are provided with a flat flange that extends outwardly from the major diameter of the conical baffle to the internal diameter of the cylindrical housing. Reduced diameter spacer elements are positioned between the baffles, and the flat flange provides support and permits axial positioning of the reduced diameter spacer elements between the baffles. The reduced diameter spacer elements are positioned so that they are positioned against one of the external annular shoulders of a baffle and the flat flange of a prior baffle, and dividing the expansion chamber between baffle elements into two concentric expansion chambers. The reduced diameter spacer elements are provided with at least one gas port to allow flow of gases from the inner expansion chamber to the outer expansion chamber.

6 Claims, 9 Drawing Sheets

SOUND SUPPRESSOR

BACKGROUND OF THE INVENTION

1. Field of the Invention

The present invention relates to a sound suppressor for a firearm, and more particularly to a sound suppressor for a firearm that comprises a housing containing at least one baffle that is of a conical structure.

2. Background of the Invention

Firearms when discharged produce a high intensity impulse sound, and to reduce this high intensity impulse sound, many different sound suppressors for firearms have been developed and patented over a long period of time. A wide variety of techniques have been developed and patented to produce effective sound suppressors. The most efficient sound suppressors have used combinations of baffles and varying sized expansion chambers, or heat absorbent materials. Regardless of the techniques used, the aim and intention of a sound suppressor is to delay the exit of the propellant gases from the sound suppressor so that the resulting sound level is significantly reduced.

Baffles have been extensively used to achieve high levels of reduction with sound suppressors for firearms, and the use of quite complex baffle structures are known in the prior art. Some of these baffles have more recently used asymmetric features, such as slanted sidewalls or baffles that have been positioned at an angle to the bore, to achieve high levels of sound reduction. Other baffles have been of a symmetrical design to minimize detrimental effects on the accuracy of the host firearm. Conical baffles have been used extensively over many years and a great many variations exist. Conical baffles may be of a truncated design, a frusto-conical design or a conical baffle with a spiral vane on the exterior surface of the baffle. Many variations of the basic conical baffle are due to changes in the angle of the conical baffle, and the addition of structures to the conical baffle to aid in improving the sound reduction level of the suppressor. Some of these structures have included the addition of a tube protruding from the apex of the cone, with the tube varying in length. Other structural additions have included a flat or curved flange positioned along the exterior surface of the cone.

U.S. Pat. No. 3,385,164 (Walther et al) discloses the use of conical baffles that feature a plurality of steps or multiple annular shoulders on the interior surface of a conical baffle. Also disclosed was the use of these multiple annular shoulders on the exterior and interior surfaces of a conical baffle. However, the use of these conical baffles with annular shoulders was in conjunction with other techniques and these conical baffles were positioned and only used in the area of the suppressor closest to the muzzle exit of the suppressor.

One variation of the baffled sound suppressor is known as the coaxial suppressor. One version of the coaxial suppressor uses baffles that are separated by reduced diameter spacers that are concentric to the bore of the suppressor, with the spacers being ported to allow venting of the propellant gases to the outer expansion chamber. Another version of the coaxial suppressor uses a reduced diameter housing containing baffles and spacers, and this is positioned concentrically within an outer housing. Porting of the inner housing allows for venting of the gases to the outer expansion chamber. U.S. Pat. No. 4,567,083 (Seberger) features the use of reduced diameter coaxial spacer elements that are ported between groups of conical baffles, but the baffles themselves have conventional spacer elements between each baffle. Each baffle is also ported at varying positions. U.S. Pat. No. 6,575,074 (Gaddini) features baffles that have integral reduced diameter coaxial spacer elements, and these are vented in a specific manner, dependent upon the caliber of the host firearm. The baffle featured in the Gaddini patent has a small conical portion that fits within the reduced diameter coaxial spacer element when assembled, and the bore aperture is provided with an elongated slot.

It is an object of this invention to provide a sound suppressor for a firearm that significantly produces high levels of sound and flash reduction using conical baffles that utilize symmetrical structures and have little or no detrimental effect on the accuracy of the fired projectile.

Additional objects, advantages, and novel features of the invention will be set forth in part in the description as follows, and in part will become apparent to those skilled in the art upon examination of the following, or may be learned by practice of the invention.

SUMMARY OF THE INVENTION

The present invention is a sound suppressor for a firearm for reducing sound and flash levels upon the discharge of a firearm. The sound suppressor comprises a cylindrical housing, a circular proximal end with means for attachment to a firearm and to the cylindrical housing, a circular distal end with means for attachment to the housing, and a plurality of symmetrical conical baffles positioned within the housing and between the proximal and distal ends of the suppressor. Separate spacer elements having an external diameter less than or slightly less than the internal diameter of the cylindrical housing are positioned between the proximal and distal ends of the suppressor and between the plurality of symmetrical conical baffles. These spacers provide support and axial positioning of the baffles within the cylindrical housing of the suppressor. The circular distal end of the suppressor is provided with a concentric circular hole therein for the projectile to pass through the distal end of the suppressor. Expansion chambers are formed between the proximal and distal ends of the suppressor and the baffles within the suppressor.

In a preferred embodiment, the sound suppressor utilizes symmetrical conical baffles that are provided with a hemispherical shaped apex, said apex being provided with a concentric circular hole for the projectile to pass through. The symmetrical conical baffles are also provided with a plurality of steps or annular shoulders on the exterior of the baffle, and these annular shoulders increase in diameter with respect to their position on the exterior of the baffle and with respect to distance from the hemispherical shaped apex of the baffle.

In another preferred embodiment, the symmetrical conical baffles are provided with a flat flange that extends outwardly from the diameter of the exit area of the conical baffle out to the internal diameter of the cylindrical housing. When the suppressor uses spacer elements that are less than the internal diameter of the cylindrical housing, and these reduced diameter spacer elements are positioned between the symmetrical baffles, the flat flange provides support and permits axial positioning of the reduced spacer elements between the baffles. In this preferred embodiment, the rear or proximal end of a spacer element is positioned against the flat flange of a baffle and the front or distal end of the spacer element is positioned against one of the annular shoulders of a baffle. In this embodiment, the expansion chambers between baffles are divided to form coaxial concentric expansion chambers. The reduced diameter spacer elements are provided with at least one gas port to allow flow of the propellant gases from the inner coaxial expansion chamber to the outer coaxial expansion chamber and then back into the inner expansion chamber and forward through the conical baffle and into the following expansion chambers and baffles before exiting the suppressor.

In another preferred embodiment, the sound suppressor features a combination of reduced diameter spacer elements and spacer elements that are slightly less than the internal diameter of the cylindrical housing positioned between the symmetrical conical baffles.

Other objects and advantages of the present invention will become apparent to those skilled in the art from the following detailed descriptions given herein; it should be understood, however, that the detailed descriptions, while indicating preferred embodiments of the invention, are given by way of illustration only. Accordingly, the drawings and descriptions of the preferred embodiments are to be regarded as illustrative only, and not as restrictive.

BRIEF DESCRIPTION OF THE DRAWINGS

Referring particularly to the drawings for the purposes of illustration only, and not limitation.

DESCRIPTION OF THE PREFERRED EMBODIMENTS

Figure 1:
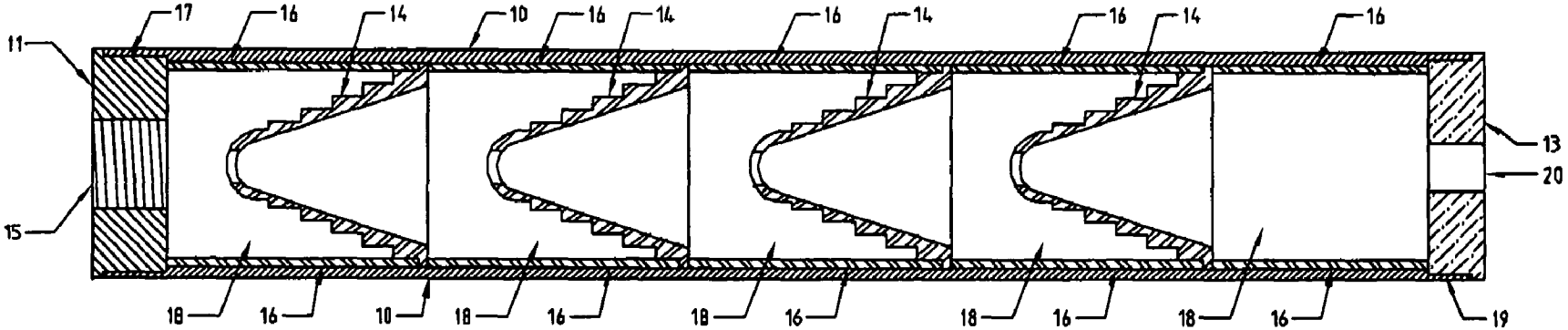
FIG. 1 is a sectional view of the invention showing a firearm sound suppressor.

Referring to the drawings, FIG. 1 shows sound suppressor 10 in a preferred embodiment in a longitudinal sectional view. The cylindrical sound suppressor housing 12 is shown with baffle elements 14 and spacer elements 16 forming a series of expansion chambers 18 between the baffle elements 14 and the proximal end 11 and the distal end 13. The proximal end 11 has internal threads 15 to attach to the muzzle end of a firearm and also has external threads 17 to attach to the cylindrical sound suppressor housing 12. The distal end 13 has external threads 19 to attach to the cylindrical sound suppressor housing 12 and is provided with a concentric circular hole or aperture 20 for the projectile to pass through. Proximal end 11 and distal end 13 may also be secured to the cylindrical sound suppressor housing by welding or other means.

A spacer element 16 is positioned between the proximal end 11 and the first baffle element 14 and this forms an initial gas expansion chamber 18. Additional spacer elements 16 are positioned between baffle elements 14 to form additional expansion chambers 18 and between the last baffle element 14 and the distal end 13 to form a final expansion chamber 18.

Figure 2:
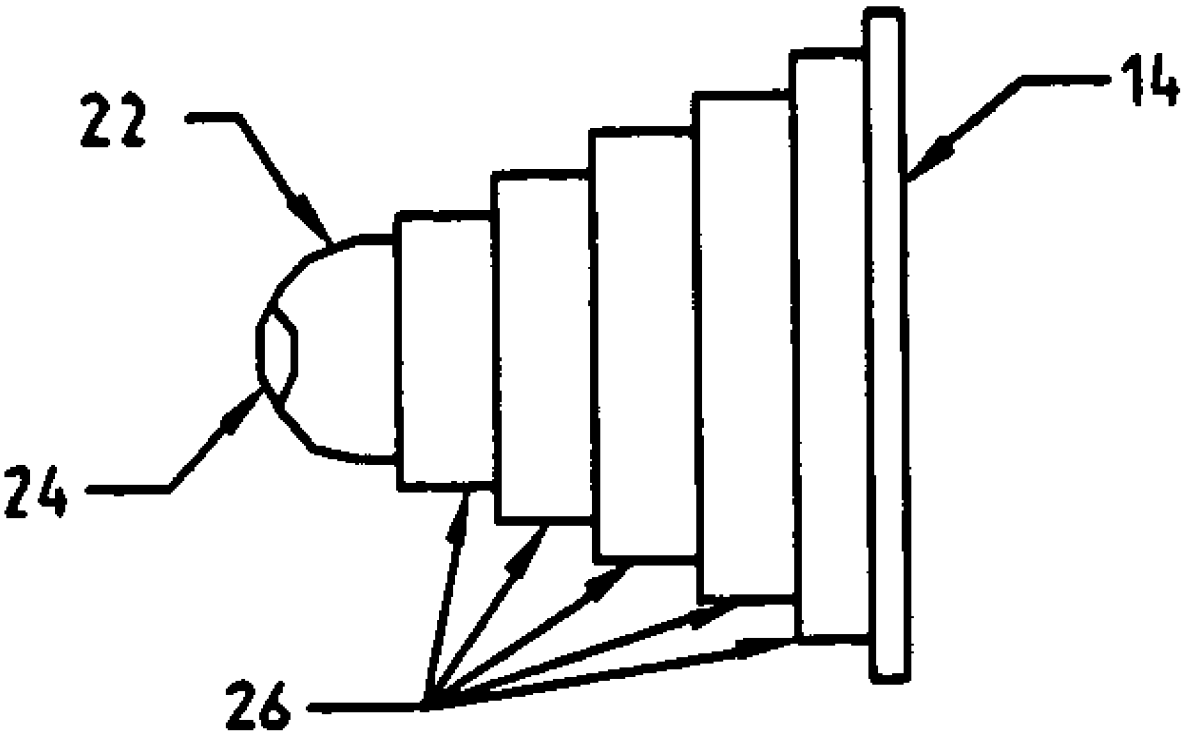
FIG. 2 is a lateral view of the symmetrical conical baffle.
Figure 3:
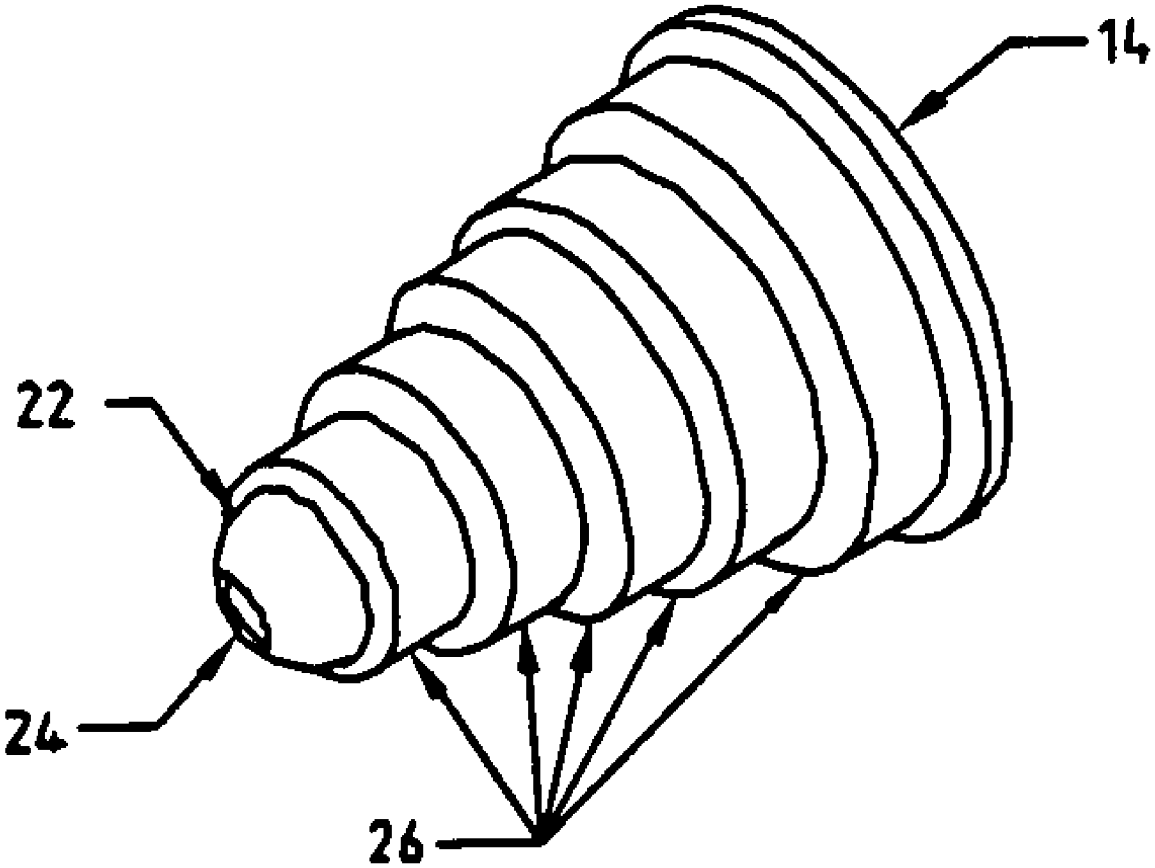
FIG. 3 is a front face perspective view of the symmetrical conical baffle.
Figure 4:
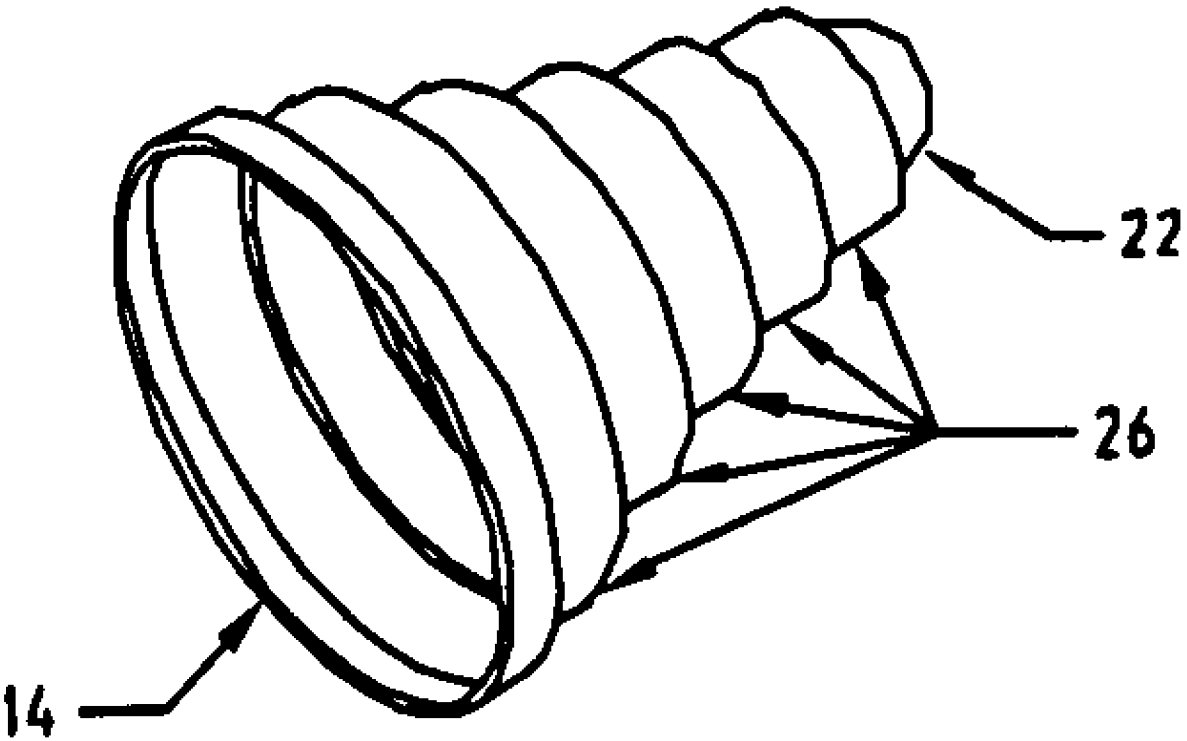
FIG. 4 is a rear face perspective view of the symmetrical conical baffle.

FIGS. 2,3, and 4 show baffle element 14. Baffle element 14 consists of a conical baffle with the apex of the conical baffle pointing towards the muzzle of the firearm and the conical baffle having a hemispherical surface 22 at the apex of the baffle. The baffle has a bore aperture 24. Baffle 14 has a plurality of steps or annular shoulders 26 on the exterior surface of the baffle. One of these annular shoulders is provided to allow for the spacer elements 16 to interface with the outer periphery of the baffles 14 and to provide axial positioning of the baffles 14 within the sound suppressor 10. Baffle 14 is provided with an opening 28 at the front of the baffle and this assists in the outward flow of the gases as they flow forward through the bore aperture 24 and into successive expansion chambers.

The plurality of annular shoulders 26 on the exterior surface of the baffles 14 also provides a disruptive surface to the outward expansion of the propellant gases upon firing of the host firearm. The hemispherical surface 22 at the apex of the conical baffle has been found to be greatly beneficial in deflecting and directing the expanding propellant gases away from the bore aperture 24 and onto and over the disruptive surfaces of the annular shoulders 26.

It should be understood that while spacer elements 16 are shown with a fixed length and thus the expansion chambers 18 are of the same volume, this is for illustrative purposes only and it should be understood that the length of the spacer elements 16 and the corresponding volume of the expansion chambers 18 may be varied, depending upon the caliber of the host firearm.

In practice, after the firearm is discharged the projectile passes through the proximal end 11 and into an expansion chamber 18, the gases flow forward and expand into the expansion chamber 18. Gases flow forward and outward impinging upon the hemispherical surface 22 at the apex of baffle element 14. The hemispherical surface 22 helps divert and deflect the gases away from the bore aperture 24 at the same time that the gases are expanding and impinging upon the annular shoulders 26, creating turbulence within the expansion chamber 14. The combination of the angle of the conical baffle element 14 and the hemispherical surface 22 at the apex of the conical baffle aids in providing a very effective means of directing and deflecting gases away from the bore aperture 24 of the conical baffle. The turbulence caused within expansion chamber 18 by the annular shoulders 26 coupled with the expansion of gases in expansion chamber 18 and the combination of the angle of the baffle element and the hemispherical surface 22 at the apex of the baffle element 14 causes the gases to take longer to exit gas expansion chamber 18 via the baffle element. This process is repeated within successive expansion chambers 18 until the gases exit the sound suppressor with neatly reduced velocity and pressure, coupled with a reduction in the noise level. The surface area of the baffle elements also provide a large surface area for the cooling of the expanding gases, thus aiding in reducing the gas flow rate by the transfer of thermal energy from the gases to the coaxial spacer elements and baffle elements.

Figure 5:
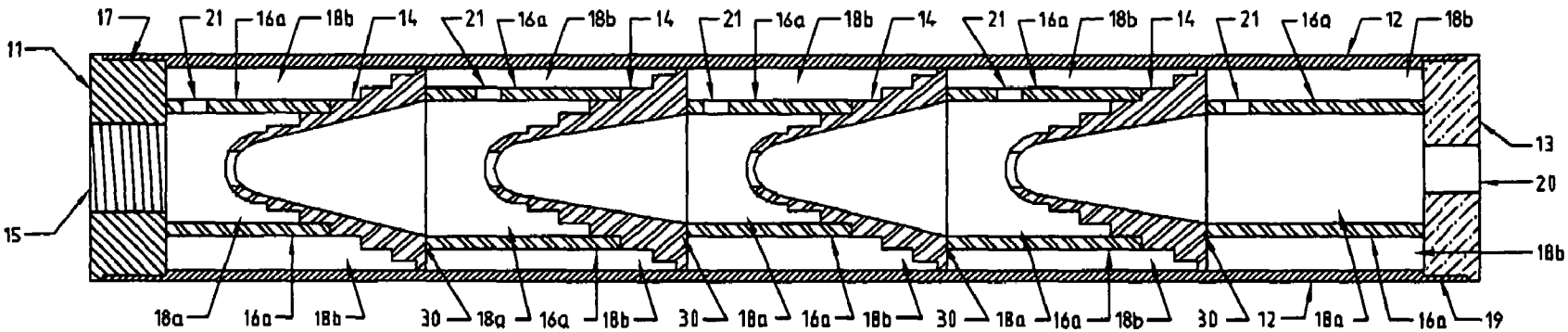
FIG. 5 is a sectional view of the invention showing a firearm sound suppressor showing an alternate embodiment of a baffle with an alternate embodiment of the spacer elements.

With reference to FIG. 5, another preferred embodiment of the invention in a longitudinal sectional view is shown. Sound suppressor 10 has a cylindrical sound suppressor housing 12 with baffle elements 14 and reduced diameter coaxial spacer elements 16*a* forming a series of inner expansion chambers 18*a* and outer expansion chambers 18*b* between the baffle elements 14 and the proximal end 11 and the distal end 13. The proximal end 11 has internal threads 15 to attach to the muzzle end of a firearm and also has external threads 17 to attach to the cylindrical sound suppressor housing 12. The distal end 13 has external threads 19 to attach to the cylindrical sound suppressor housing 12 and is provided with a concentric circular hole or aperture 20 for the projectile to pass through. Proximal end 11 and distal end 13 may also be secured to the cylindrical sound suppressor housing by welding or other means.

A reduced diameter coaxial spacer element 16*a* is positioned between the proximal end 11 and the first baffle element 14 and this forms an inner initial gas expansion chamber 18*a* and an outer initial gas expansion chamber 18*b*. Additional reduced diameter coaxial spacer elements 16*a* are positioned between baffle elements 14 to form additional inner expansion chambers 18*a* and outer expansion chambers 18*b* and between the last baffle element 14 and the distal end 13 to form final inner expansion chamber 18*a* and outer expansion chamber 18*b*. Reduced diameter coaxial spacer elements 16*a* are provided with at least one gas port 21 to permit venting of the propellant gases from within the inner expansion chamber 18*a* to the outer expansion chamber 18*b*.

Figure 6:
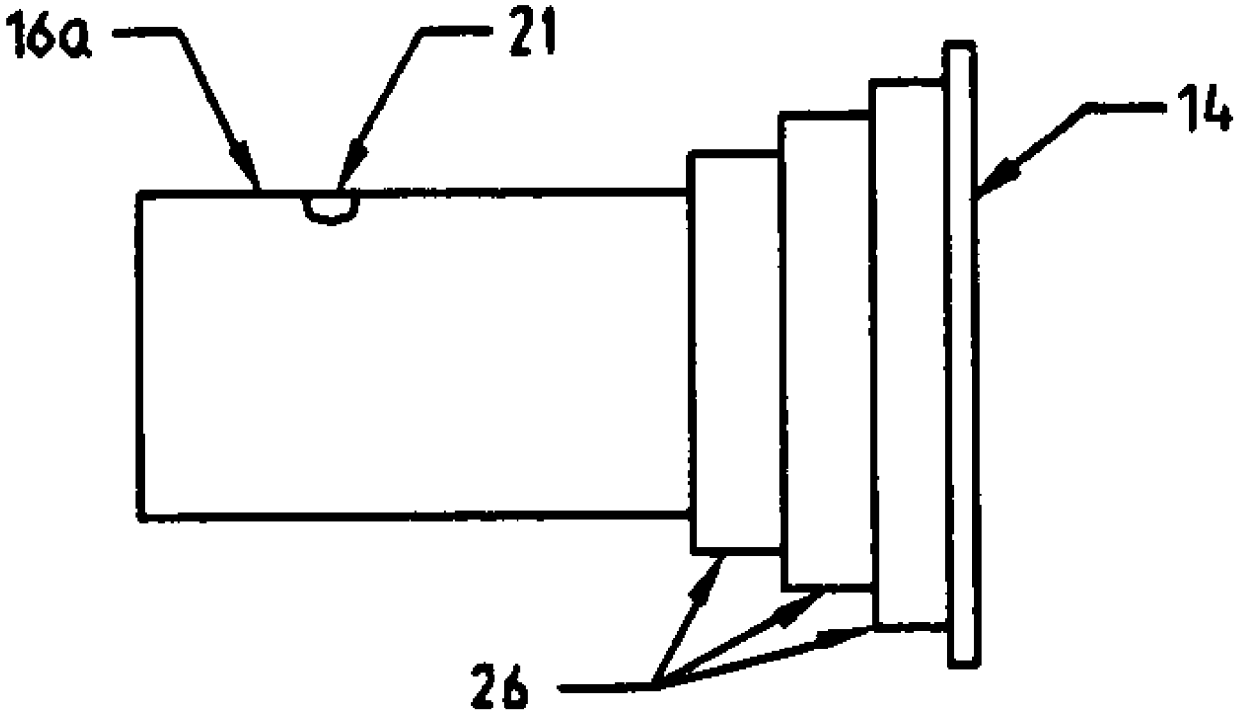
FIG. 6 is a lateral view of an alternate embodiment of the symmetrical conical baffle with an alternate embodiment of the spacer element.
Figure 7:
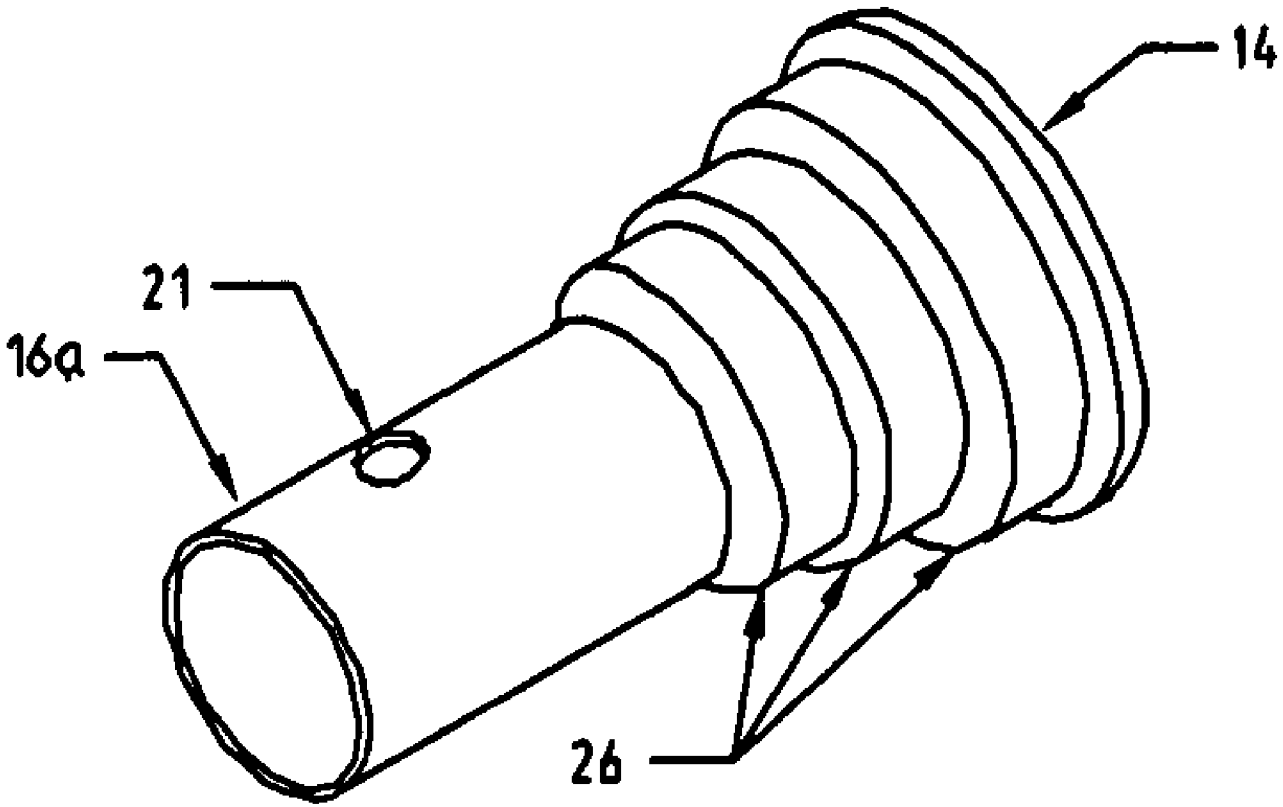
FIG. 7 is a front face perspective view of the alternate embodiment of the symmetrical conical baffle with the alternate embodiment of the spacer element positioned on the exterior of the baffle.
Figure 8:
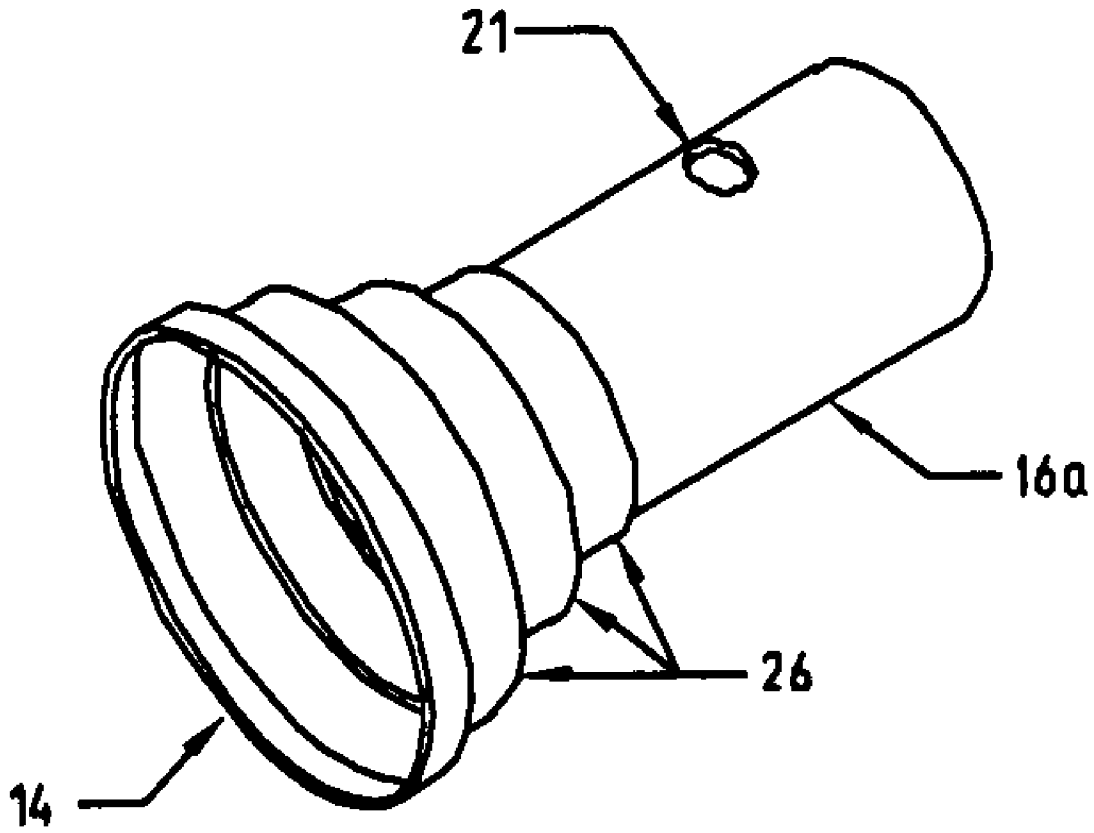
FIG. 8 is a rear face perspective view of the alternate embodiment of the symmetrical conical baffle with the alternate embodiment of the spacer element positioned on the exterior of the baffle.

FIGS. 6,7, and 8 show an alternate embodiment of baffle 14. Baffle element 14 comprises a conical baffle with the apex of the conical baffle pointing towards the muzzle of the firearm and the conical baffle having a hemispherical surface 22 at the apex of the baffle. The baffle has a bore aperture 24. Baffle 14 has a plurality of steps or annular shoulders 26 on the exterior surface of the baffle. These annular shoulders are provided to allow for the reduced diameter coaxial spacer elements 16*a* to interface with the outer periphery of the baffles 14 and to provide axial positioning of the baffles 14 within the sound suppressor 10. Baffle 14 is provided with an opening 28 at the front of the baffle and this assists in the outward flow of the gases as they flow forward through the bore aperture 24 and into successive expansion chambers. Baffle 12 is provided with a flat flange 30 at the front of the baffle. Flat flange 30 extends outwardly from the diameter of the exit area of the conical baffle to the internal diameter of the cylindrical housing. The width of the flat flange 30 is such that, when combined with the angle of the conical baffle, it provides support to and permits axial positioning of the reduced diameter coaxial spacer elements when such spacers are used in this embodiment of the invention. Reduced diameter coaxial spacer 16*a* is shown with at least one gas port 21 to vent gases from the inner expansion chamber 18*a* to the outer expansion chamber 18*b*.

With this embodiment, after the firearm is discharged the projectile passes through the proximal end 11 and into the initial inner expansion chamber 18*a*, the gases flow forward and expand into the initial inner expansion chamber 18*a*. Inner initial expansion chambers 18*a* and 18*b* are formed by the use of the reduced diameter coaxial spacer element 16*a*. Gases flow forward and outward impinging upon the hemispherical surface 22 at the apex of baffle element 14. The hemispherical surface 22 helps divert and deflect the gases away from the bore aperture 24 at the same time that the gases are expanding and impinging upon the annular shoulders 26 that are within the inner expansion chamber 18*a* creating turbulence within the expansion chamber 18*a*. Gases also are vented from the inner initial expansion chamber 18*a* to the outer initial expansion chamber 18*b* through gas port 21 that is in spacer element 16*a*. Gas port 21 may be positioned at an angle to the axis of the sound suppressor to provide venting of the gases onto and over the annular shoulders that are within the outer expansion chamber 18*b*. This provides turbulence within the outer expansion chamber 18*b* and assists in retarding the exit of the gases from the outer chamber 18*b* back into the inner chamber 18*a*. The combination of the angle of the conical baffle element 14 and the hemispherical surface 22 at the apex of the conical baffle aids in providing a very effective means of directing and deflecting gases away from the bore aperture 24 of the conical baffle. The turbulence caused within both expansion chambers 18*a* and 18*b* by the annular shoulders 26 coupled with the expansion of gases in both expansion chambers 18*a* and 18*b* causes the gases to take longer to exit both gas expansion chambers 18*a* and 18*b* via the baffle element. This process is repeated within successive expansion chambers 18*a* and 18*b* until the gases exit the sound suppressor with greatly reduced velocity and pressure, coupled with a reduction in the noise level.

Figure 9:
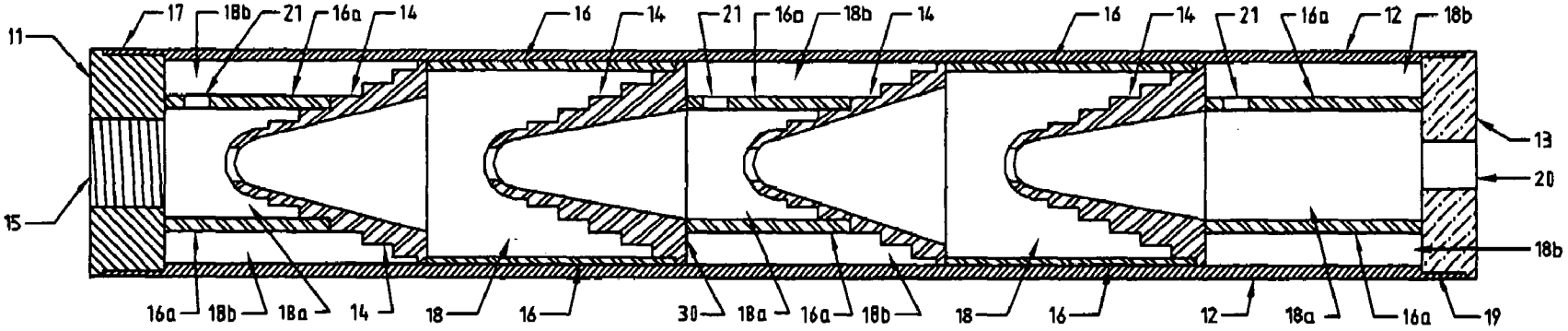
FIG. 9 is a sectional view of the invention showing a firearm sound suppressor mounted onto a firearm barrel showing another alternate embodiment with a combination of spacer elements and alternate spacer elements.

FIG. 9 shows yet another alternate embodiment, and this embodiment uses a combination of conventional spacer elements 16 and reduced diameter coaxial spacer elements 16*a* to form a combination of conventional expansion chambers 18, and inner and outer expansion chambers 18*a* and 18*b*. The number and size of the expansion chambers will become readily apparent to those skilled in the art and determined by empirical studies to maximize sound reduction levels.

The unique symmetrical conical baffle sound suppressor of the invention provides much versatility in the arrangements of the baffles and spacer elements with respect to the caliber and type of the host firearm. Center fire rifle calibers may use one form of spacer element while center fire pistol calibers may use another form of spacer element. If so desired, a combination of the spacer elements may be used with both rifle and pistol calibers. Regardless of the caliber of the host firearm, there is little detrimental effect on the accuracy of the host firearm, and this is of high importance when being used on sniper rifles. The new sound suppressor disclosed offers an improvement in the state of the art.

While the invention has been described in a number of specific embodiments for purposes of explanation and illustration, numerous variations, modifications and substitutions will be readily apparent to those skilled in the art. Accordingly, it is not intended to limit the invention to the precise forms and descriptions detailed, and it is intended that the invention be defined by the following claims.

The invention claimed is:

1. A sound suppressor for a firearm, comprising:— a cylindrical housing, a proximal end, a distal front end, at least one baffle element, and a plurality of spacer elements positioned within said housing, and a plurality of expansion chambers, said proximal end having means for attachment to said cylindrical housing and having means for attachment to the muzzle of a firearm, said distal end having means for attachment to said cylindrical housing and a circular concentric hole, the baffle element comprising a conical baffle with a hemispherical shaped apex, the plurality of spacer elements positioned between the proximal end, the baffle element and the distal end of the sound suppressor, and said expansion chambers positioned between the proximal end, the baffle element and the distal end of said sound suppressor.

2. The sound suppressor of claim 1, including:— a plurality of the baffle elements positioned within the cylindrical housing between the proximal end and the distal end in a spaced relationship, a plurality of spacer elements positioned within the cylindrical housing between the baffle elements and between the proximal and distal ends of the suppressor, and said plurality of expansion chambers positioned between the proximal end, the baffle elements and the distal end of the sound suppressor.

3. A sound suppressor for a firearm, comprising:— a cylindrical housing, a proximal end, a distal front end, at least one baffle element, and a plurality of spacer elements positioned within said housing, and a plurality of expansion chambers, said proximal end having means for attachment to said cylindrical housing and having means for attachment to the muzzle of a firearm, said distal end having means for attachment to said cylindrical housing and a circular concentric hole, the baffle element comprising a conical baffle with a hemispherical shaped apex, and having a plurality of annular shoulders on the exterior of said baffle, said annular shoulders increasing in diameter in relation to said position of said annular shoulders on the exterior of said baffle and in relation to said position of said annular shoulders from said hemispherical shaped apex of said conical baffle, the plurality of spacer elements positioned between the proximal end, the baffle element and the distal end of the sound suppressor, said plurality of expansion chambers positioned between the proximal end, the baffle element and the distal end of the sound suppressor.

4. The sound suppressor of claim 3, including:— a plurality of said baffle elements positioned within the cylindrical housing between the proximal end and the distal end in a spaced relationship, a plurality of spacer elements positioned within the cylindrical housing between the baffle elements and between the proximal and distal ends of the suppressor, and said plurality of expansion chambers positioned between the proximal end, the baffle elements and the distal end of the sound suppressor.

5. A sound suppressor as claimed for in claim 3 wherein spacer element positioned between said proximal end and adjacent baffle element has an external diameter equal to the diameter of at least one of said plurality of annular shoulders positioned on the exterior of said baffle, said spacer element being provided with at least one gas port, and whereby said spacer element divides the expansion chamber between said proximal end and adjacent baffle into two expansion chambers.

6. A sound suppressor as claimed for in claim 4, wherein at least one spacer element has an external diameter equal to the diameter of at least one of said plurality of annular shoulders positioned on the exterior of said baffles, said spacer element being provided with at least one gas port, whereby at least one said spacer element divides at least one expansion chamber into two expansion chambers, and whereby said spacer element is positioned axially between said flat flange and an annular shoulder of two adjacent baffles.

* * * * *